United States Patent [19]

Wilson

[11] 4,213,606

[45] Jul. 22, 1980

[54] DEVICE TO IMPROVE SHOOTING A BASKETBALL

[76] Inventor: Robert E. Wilson, 636 E. Main, Mulvane, Kans. 67110

[21] Appl. No.: 26,035

[22] Filed: Apr. 2, 1979

[51] Int. Cl.[2] ..... A63B 63/00; A63B 69/00

[52] U.S. Cl. ..... 273/1.5 A

[58] Field of Search ..... 273/1.5 R, 1.5 A

[56] References Cited

U.S. PATENT DOCUMENTS

| | | | |
|---|---|---|---|
| 2,039,794 | 5/1936 | Hayden | 273/1.5 A |
| 2,708,576 | 5/1955 | Verkuilen | 273/1.5 A |
| 2,918,283 | 12/1959 | Marschalk | 273/1.5 A |
| 3,342,486 | 9/1967 | Farley | 273/1.5 A |

*Primary Examiner*—Paul E. Shapiro

*Attorney, Agent, or Firm*—John H. Widdowson

[57] ABSTRACT

A basketball training device having a support hoop of essentially the same diameter of the conventional hoop to circumferentially mate with same; a secondary hoop of larger diameter relative to the conventional hoop; arms for attaching the support hoop to the secondary hoop; and clamps for removably connecting the support hoop to the conventional hoop. A method for improving the shooting accuracy of a basketball player comprising positioning the secondary hoop with the portion nearest the backboard tangential and coplanar with the conventional hoop, and with the portion opposite the backboard projecting upwardly and outwardly from the conventional hoop.

5 Claims, 4 Drawing Figures

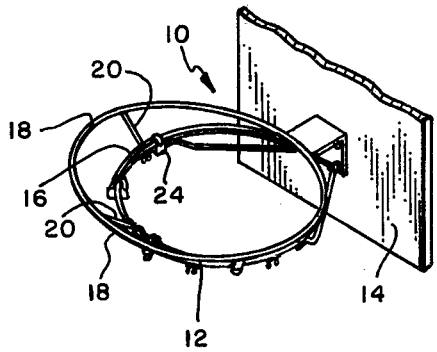
FIG. 1
FIG. 2
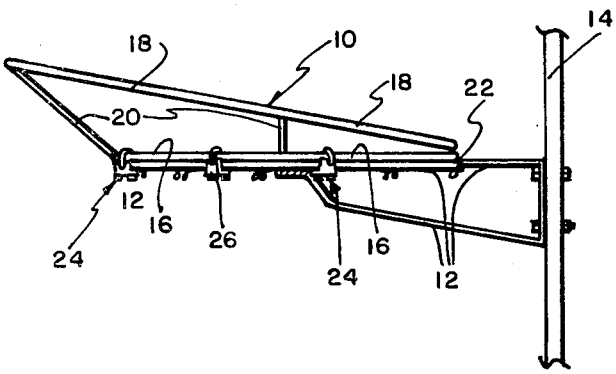
FIG. 3
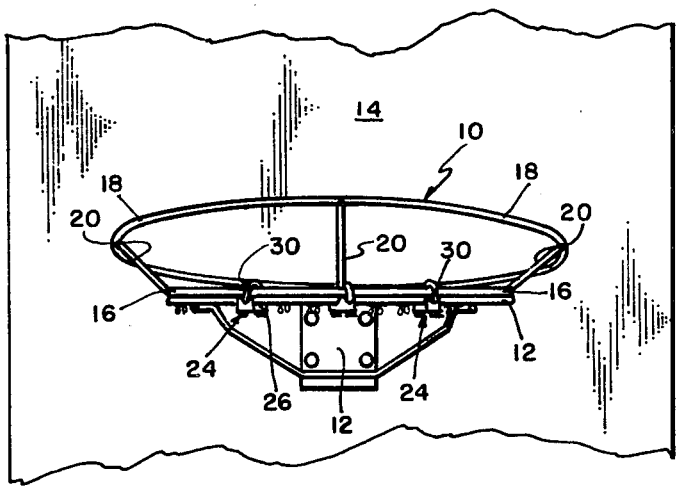
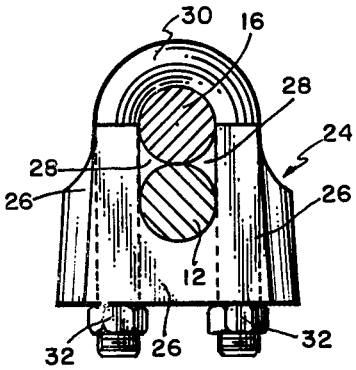
FIG. 4

DEVICE TO IMPROVE SHOOTING A BASKETBALL

BACKGROUND OF THE INVENTION

1. Field of the Invention

This invention is related to a method and device for improving the shooting accuracy of a basketball player.

2. Description of the Prior Art

U.S. Pat. No. 3,342,486 by W. E. Farley discloses a practice rail attachment for a basketball backboard; U.S. Pat. No. 2,039,794 by E. S. Hayden teaches a basketball practice device having two rings with interconnecting elements therebetween; and U.S. Pat. No. 2,918,283 by P. M. Marschalk discloses a basketball practice device which can be mounted on a standard basketball goal and has a slightly smaller diameter than the basketball goal. None of these patents teach this invention.

SUMMARY OF THE INVENTION

It is therefore an object of this invention to provide a method and device to improve the arch of shooting a basketball.

It is another object of this invention to provide a method and device to eliminate the basketball from being buried on the underneath side of the basketball goal on lay-ups.

It is still another object of this invention to provide a device which would improve the location that a basketball is placed on backboard when shooting lay-ups.

It is still yet another object of this invention to provide a method and device which would improve the positioning of a basketball on the backboard when shooting at an angle off the backboard.

Other objects of the invention will become apparent to those skilled in the art.

Broadly this invention provides a method of improving the shooting accuracy of a basketball player by eliminating the tendency to bury the ball between the backboard and the hoop at the underside thereof comprising the step of positioning a secondary hoop of larger diameter relative to the conventional hoop so that the secondary hoop is tangential and co-planar with the conventional hoop at the point on the conventional hoop adjacent to the backboard and so that the portion of the secondary hoop opposite the backboard projects upward and outwardly relative to the corresponding portion of the conventional hoop, whereby the shooter is encouraged to bank the basketball from an optimum position on the backboard. This invention also provides a basketball training device for a conventional basketball hoop and backboard assembly wherein the conventional hoop is movably positioned in a horizontal plane comprising a support hoop of essentially the same diameter of the conventional hoop to circumferentially mate with same; a secondary hoop of larger diameter relative to the conventional hoop; interconnecting means for attaching the support hoop to the secondary hoop; and means for removably connecting the support hoop to the conventional hoop. The secondary hoop is tangential and co-planar with the conventional hoop and the support hoop at the point on the conventional hoop adjacent to the backboard and the portion of the secondary hoop opposite the backboard projects upward and outwardly relative to the corresponding portion of the conventional hoop and support hoop. The device of my invention in use provides for the player in practice to learn to shoot more accurately by aiming the basketball in shooting so that it strikes the backboard in a location and at an angle most favorable for the ball to ricochet off the backboard and into the basket, and by shooting the ball at the basket at a greater arch than some players would normally.

Other advantages and objects of the invention will become evident from the following detailed description when read in conjunction with the following accompanying drawings which illustrate the preferred embodiments of the invention:

BRIEF DESCRIPTION OF THE DRAWINGS

FIG. 1 is a perspective view of the invention mounted on a conventional basketball goal;

FIG. 2 is a side elevational view of the invention mounted on the conventional basketball goal;

FIG. 3 is a front elevational view of the invention mounted on the conventional basketball goal; and FIG. 4 is a front elevational view of the clamping device of the invention with the conventional basketball goal and support hoop having a vertical sectional view and enclosed in the clamping device.

DETAILED DESCRIPTION OF THE INVENTION

Referring in detail now to the drawings, wherein similar parts of the invention are identified by like reference numerals, there is seen a basketball training device, generally illustrated as 10, mounted on a conventional basketball hoop 12 which is attached to the backboard 14. Training device 10 comprises a support hoop 16 having essentially the same diameter as the conventional hoop 12 to circumferentially mate with the conventional hoop 12, and a secondary hoop 18 which has a larger diameter than the conventional hoop 12 and the support hoop 16. Interconnecting means 20, which in a preferred embodiment of the invention includes three support members 20, are attached to the support hoop 16 and the secondary hoop 18 to maintain the secondary hoop 18 in an essentially radial position relative to the support hoop 16. The secondary hoop 18 is tangential and co-planar with the conventional hoop 12 and the support hoop 16 at the point 22 (see FIG. 2) on the conventional hoop 12 adjacent to the backboard 14, and a portion of the secondary hoop 18 opposite the backboard 14 projects upward and outwardly relative to the corresponding portion of the conventional hoop 12 and the support hoop 16.

Means, generally illustrated as 24 (see FIG. 4), removably connects the support hoop 16 with the conventional hoop 12. On a preferred embodiment of the invention means 24 comprises a clamp 26 having a structure defining two apertures and a channel 28 for housing a portion of the conventional hoop 12 and the support hoop 16; and a U-bolt 30 slidably lodges in the apertures and encases a portion of the conventional hoop 12 and the support hoop 16. A pair of nuts 32 threadably connects to the U-bolt 30.

With continuing reference to the drawings, it can readily be seen that by use of this invention a basketball player would be encouraged to bank a basketball off the backboard 14 and eliminate a tendency to bury a basketball between the backboard 14 and the conventional hoop 12 at the underside thereof. This is made possible by positioning the secondary hoop 18 so that the secondary hoop 18 is tangential and co-planar with the conventional hoop 12 and support hoop 16 at point 22 adjacent the backboard 14 and by having a portion of the secondary hoop 18 opposite the backboard 14 projecting upwardly and outwardly relative to the corresponding portion of the conventional hoop 12 and support hoop 16.

Changes may be made in the construction and arrangement of the parts or elements of the embodiment as described herein without departing from the spirit or scope of the invention as defined in the following claims.

I claim:

1. A method of improving the shooting accuracy of a basketball player by eliminating the tendency to bury the ball between the backboard and the hoop at the underside thereof comprising the step of:

(a) positioning a secondary hoop of larger diameter relative to the conventional hoop so that the secondary hoop is tangential and co-planar with the conventional hoop and a support hoop at the point on the conventional hoop and support hoop adjacent to the backboard and so that the portion of the secondary hoop opposite the backboard projects upward and outwardly relative to the corresponding portion of the conventional hoop and the support hoop whereby the shooter is encouraged to bank the basketball from an optimum position on the backboard.

2. A basketball training device for a conventional basketball hoop and backboard assembly wherein said conventional hoop is normally positioned in a horizontal plane comprising:

(a) a support hoop of essentially the same diameter of the conventional hoop to circumferentially mate with same;

(b) a secondary hoop of larger diameter relative to the conventional hoop;

(c) interconnecting means for attaching said support hoop to said secondary hoop;

(d) means for removably connecting said support hoop to said conventional hoop;

said secondary hoop being tangential and co-planar with the conventional hoop and the support hoop at the point on the conventional hoop adjacent to the backboard, and a portion of said secondary hoop opposite the backboard projects upward and outwardly relative to the corresponding portions of the conventional hoop and support hoop.

3. The device of claim 2 wherein said interconnecting means maintains said secondary hoop in an essentially radial position relative to said support hoop and includes at least one support member.

4. The device of claim 3 wherein said interconnecting means comprises three support members.

5. The device of claim 4 wherein said means for removably connecting said support hoop to said conventional hoop comprises a clamp means having a structure defining two apertures and a channel for housing a portion of the conventional hoop and the support hoop; a U-bolt slidably lodging in said apertures and encasing said portions of said conventional hoop and said support hoop; and a pair of nuts for securing to said U-bolt.

* * * * *